US011427941B2

(12) United States Patent
Ota

(10) Patent No.: US 11,427,941 B2
(45) Date of Patent: Aug. 30, 2022

(54) WEB STRUCTURAL BODY AND MANUFACTURING APPARATUS THEREOF

(71) Applicant: SEIKO EPSON CORPORATION, Tokyo (JP)

(72) Inventor: Tsukasa Ota, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 203 days.

(21) Appl. No.: 16/824,748

(22) Filed: Mar. 20, 2020

(65) Prior Publication Data

US 2020/0299879 A1 Sep. 24, 2020

(30) Foreign Application Priority Data

Mar. 22, 2019 (JP) ..... JP2019-054302

(51) Int. Cl.

| | |
|---|---|
| ***D04H 1/60*** | (2006.01) |
| ***B27N 3/04*** | (2006.01) |
| ***D04H 1/425*** | (2012.01) |
| ***D21F 9/00*** | (2006.01) |
| ***B27N 3/18*** | (2006.01) |

(52) U.S. Cl.

CPC ..... *D04H 1/60* (2013.01); *B27N 3/04* (2013.01); *B27N 3/18* (2013.01); *D04H 1/425* (2013.01); *D21F 9/00* (2013.01)

(58) Field of Classification Search

CPC . D04H 1/60; D04H 1/425; B27N 1/02; B27N 3/18; B27N 3/08; B27N 3/04; B27N 1/00; D21F 9/00

USPC ..... 162/121

See application file for complete search history.

(56) References Cited

U.S. PATENT DOCUMENTS

2011/0184365 A1* 7/2011 Rottger ..... A61L 15/60 425/102
2016/0332325 A1* 11/2016 Murayama ..... B27N 3/002

FOREIGN PATENT DOCUMENTS

JP 2010-058804 A 3/2010

* cited by examiner

*Primary Examiner* — Mark Halpern
(74) *Attorney, Agent, or Firm* — Global IP Counselors, LLP

(57) ABSTRACT

A web structural body includes cellulose fibers and a binding material binding the cellulose fibers, and in the web structural body described above, a molten rate of the binding material at a surface of the web structural body is higher than a molten rate of the binding material at a center in a thickness direction of the web structural body.

3 Claims, 4 Drawing Sheets

WEB STRUCTURAL BODY AND MANUFACTURING APPARATUS THEREOF

The present application is based on, and claims priority from JP Application Serial Number 2019-054302, filed Mar. 22, 2019, the disclosure of which is hereby incorporated by reference herein in its entirety.

BACKGROUND

1. Technical Field

The present disclosure relates to a web structural body and a manufacturing apparatus thereof.

2. Related Art

Heretofore, containers formed from materials containing cellulose fibers have been used. The containers as described above have been used, for example, for food trays, and have been formed by molding into shapes, such as a plate and a delicatessen pack, in accordance with applications. For example, JP-A-2010-058804 has proposed a paper container formed from a laminate sheet composed of a hydrophobic oil absorbing paper which contains cellulose fibers as a primary component, and in this proposal, the hydrophobic oil absorbing paper forms an inside surface layer of the paper container.

However, the laminate sheet disclosed in JP-A-2010-058804 has the structure in which a thermoplastic resin layer is provided on at least one of two surfaces of a base paper layer, and when the paper container is formed by molding, the shape thereof is maintained only by the thermoplastic resin provided as a surface layer of the sheet; hence, sufficient strength/rigidity as a molded product cannot be obtained. In addition, since the laminate sheet described in the above document is formed using a high density paper as a base material, when a three-dimensional shape which requires so-called deep drawing or the like is formed, wrinkles and breakages may be generated in the molded product in some cases. Hence, a web structural body in which wrinkles and breakages are unlikely to be generated in molding is required.

SUMMARY

According to an aspect of the present disclosure, there is provided a web structural body comprising: cellulose fibers; and a binding material binding the cellulose fibers, and in the web structural body described above, a molten rate of the binding material at a surface of the web structural body is higher than a molten rate of the binding material at a center in a thickness direction of the web structural body.

In the aspect of the web structural body described above, the binding material may have a content of 5.0 to 50.0 percent by mass with respect to the web structural body.

In the aspect of the web structural body described above, the web structural body may have a thickness of 1.0 to 20.0 mm and a density of 0.02 to 0.20 g/cm$^3$.

According to another aspect of the present disclosure, there is provided a manufacturing apparatus of a web structural body, the apparatus comprising: a mixing portion mixing cellulose fibers and a binding material binding the cellulose fibers to form a mixture; a depositing portion depositing the mixture to form a deposit; and a heating portion heating the deposit to form the web structural body. In the manufacturing apparatus described above, the heating portion heats the deposit at a temperature of 70.0° C. to 220.0° C. so that a molten rate of the binding material at a surface of the web structural body is higher than a molten rate of the binding material at a center in a thickness direction of the web structural body.

In the aspect of the manufacturing apparatus described above, the heating portion may include a pair of heating rollers, and the heating rollers each may have a rotation rate of 30.0 to 350.0 rpm.

In the aspect of the manufacturing apparatus described above, the mixing portion may mix so that the binding material has a content 5.0 to 50.0 percent by mass with respect to the deposit, the depositing portion may deposit so that the deposit has a thickness of 1.0 to 150.0 mm, and the heating portion may heat so that the web structural body has a thickness of 1.0 to 20.0 mm and a density of 0.02 to 0.20 g/cm$^3$.

The manufacturing apparatus according to the aspect described above may further comprise a humidifying portion humidifying the web structural body.

DESCRIPTION OF EXEMPLARY EMBODIMENTS

Figure 1:
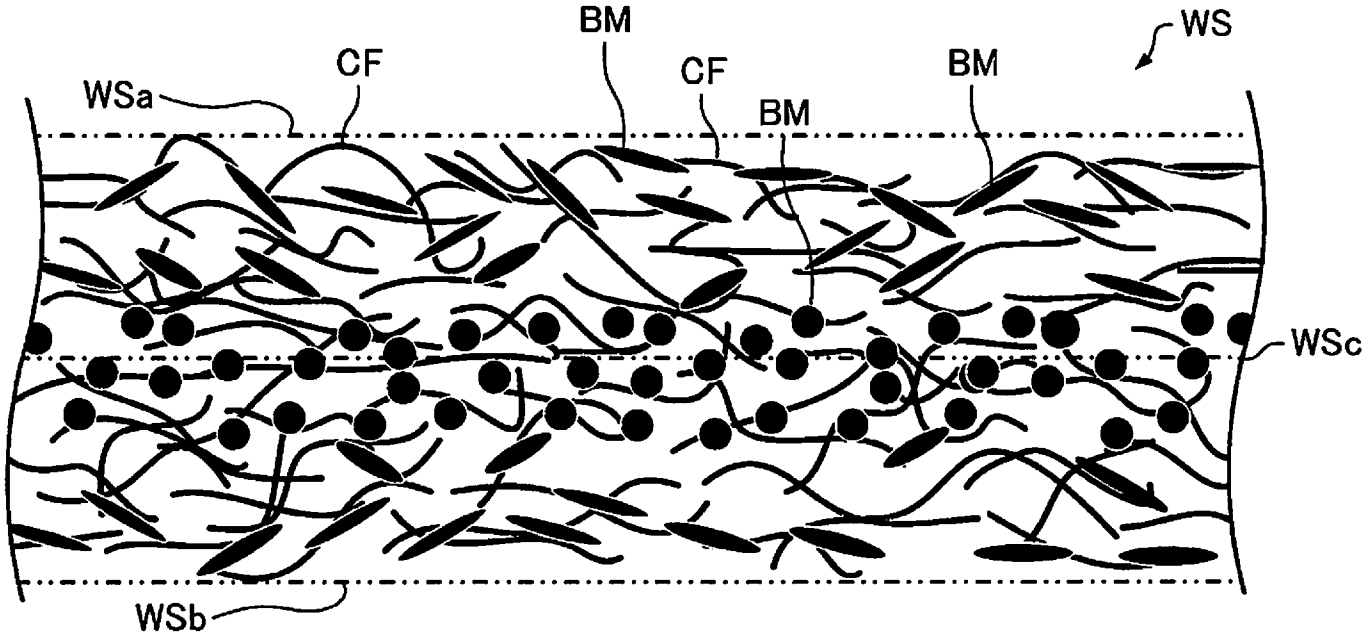
FIG. 1 is a schematic cross-sectional view of a web structural body according to an embodiment.

Hereinafter, embodiments of the present disclosure will be described. The following embodiments are each described by way of example to explain the present disclosure. The present disclosure is not limited to the following embodiments and may be variously changed and/or modified without departing from the scope of the present disclosure. In addition, all structures described below are each not always required to be an essential structure of the present disclosure.

1. WEB STRUCTURAL BODY

A web structural body of this embodiment includes cellulose fibers and a binding material binding the cellulose fibers. In addition, a molten rate of the binding material at a surface of the web structural body is higher than a molten rate of the binding material at a center in a thickness direction of the web structural body. Hereinafter, the cellulose fibers, the binding material, a distribution of the molten rate of the binding material in the thickness direction of the web structural body, and a method for forming the web structural body will be sequentially described.

1.1. Cellulose Fibers

In the web structural body of this embodiment, the cellulose fibers are used as a part of a raw material, and a plurality of cellulose fibers is contained in the web structural body. As the cellulose fibers described above, for example, there may be mentioned natural cellulose fibers (animal cellulose fibers and vegetable cellulose fibers) and chemical cellulose fibers (organic cellulose fibers, inorganic cellulose fibers, and organic-inorganic composite cellulose fibers). In more particular, as the cellulose fibers, for example, cellulose fibers formed from a cellulose, a cotton, a hemp, a kenaf, a flax, a ramie, a jute, a Manila hemp, a Sisal hemp, a coniferous tree, or a broadleaf tree may be mentioned; those cellulose fibers may be used alone, or at least two types thereof may be used in combination; and those cellulose fibers may be used after being purified or the like as regenerated cellulose fibers. In addition, the cellulose fibers may be dried, may contain a liquid, such as water or an organic solvent, or may be impregnated therewith. Furthermore, the cellulose fibers may be processed by various types of surface treatments.

When one cellulose fiber of the cellulose fibers contained in the web structural body of this embodiment is regarded as one independent cellulose fiber, the average diameter (if the cross-section thereof is not a circle, the maximum length of lengths in a direction orthogonal to a longitudinal direction or a diameter (equivalent circle diameter) of a circle assumed to have an area equivalent to that of the cross-section) is 1.0 to 1,000.0 μm and preferably 5.0 to 100.0 μm.

Although the length of the cellulose fibers contained in the web structural body of this embodiment is not particularly limited, as one independent cellulose fiber, the length thereof along the longitudinal direction is 1.0 μm to 5.0 mm. In addition, the average length of the cellulose fibers is 20.0 to 3,600.0 μm as a length-weighed average cellulose fiber length. Furthermore, the lengths of the cellulose fibers may have a deviation (in distribution).

In this specification, the cellulose fiber indicates either one independent cellulose fiber or an aggregate of cellulose fibers (such as the form of cotton). In addition, the cellulose fibers may be cellulose fibers (defibrated product) which are defibrated into fibers by a defibrating treatment performed on fibers to be defibrated. In this embodiment, as the fibers to be defibrated, there may be mentioned cellulose fibers entangled or bound together, such as a pulp sheet, paper, waste paper, tissue paper, kitchen paper, a cleaner, a filter, a liquid absorber, an acoustic absorber, a buffer, a mat, or a corrugated board.

1.2. Binding Material

The web structural body of this embodiment contains the binding material.

1.2.1. Binding Material

The binding material has a function to bind cellulose fibers to each other. The binding material may also have a function other than that to bind the cellulose fibers to each other. In addition, all the binding materials are each not always required to have a specific function. The binding material may be a composite containing a coloring material, an aggregation inhibitor, and/or the like. The binding material may also contain, for example, an organic solvent, a surfactant, a fungicide/antiseptic agent, an antioxidant/UV absorber, and/or an oxygen absorber.

The binding material may impart to the web structural body, a function, such as binding between the cellulose fibers, coloring thereof, adhesion or sticking between the web structural bodies or between the web structural body and another material, and/or flame retardancy of the web structural body. In addition, the binding material may also have a function to suppress falling of other functional materials (such as a coloring material) from the web structural body.

The binding material contains a resin. As the type of resin, either a natural resin or a synthetic resin may be used, and in addition, the binding material has thermoplasticity. Hence, the binding material is melted by heating to extend between the cellulose fibers, and as a result, the cellulose fibers are likely to be bound to each other.

As the natural resin, for example, there may be mentioned a rosin, a dammar, a mastic, a copal, an amber, a shellac, a dragon's blood, a sandarac, and/or a colophony; those resins may be used alone, or at least two types thereof may be used in combination; and those mentioned above each may be appropriately modified.

As a thermoplastic resin of the synthetic resins, for example, there may be mentioned an AS resin, an ABS resin, a polypropylene, a polyethylene, a poly(vinyl chloride), a polystyrene, an acrylic resin, a polyester resin, a poly (ethylene terephthalate), a poly(phenylene ether), a poly (butylene terephthalate), a nylon, a polyamide, a polycarbonate, a polyacetal, a poly(phenylene sulfide), or a poly (ether ether ketone).

Furthermore, as the binding material, among the synthetic resins, a biodegradable resin, such as a poly(lactic acid), a poly(butylene succinate), or a poly(hydroxy butyrate), may also be used. Since a biodegradable resin is used, the web structural body can be further improved in terms of environmental compatibility.

In addition, the resin may be copolymerized or modified, and as the resin mentioned above, for example, there may be mentioned a styrene-based resin, an acrylic-based resin, a styrene acrylic-based resin, an olefin-based resin, a vinyl chloride-based resin, a polyester-based resin, a polyamide-based resin, a polyurethane-based resin, a poly(vinyl alcohol)-based resin, a vinyl ether-based resin, an N-vinyl-based resin, or a styrene butadiene-based resin. The resins mentioned above by way of example may be used alone, or at least two types thereof may be used in combination.

The resin contained in the binding material is melted or softened preferably at 200.0° C. or less and more preferably at 160.0° C. or less in terms of energy saving. A glass transition temperature (Tg) of the resin contained in the binding material may be appropriately selected in accordance with the thickness of the web structural body and the temperature for a heat treatment and is preferably 45.0° C. or more and more preferably 50.0° C. or more. In addition, an upper limit of Tg is preferably 95.0° C. or less and more preferably 90.0° C. or less. When the glass transition temperature is 45.0° C. or more, the softening of the binding material at a high temperature can be suppressed.

The binding material may be a powder composed of particles having a volume average particle diameter smaller than the diameter of the cellulose fibers. When the binding material is a powder, the content thereof with respect to the cellulose fibers can be easily changed. In addition, since the binding material is a powder, the uniformity of attachment to the cellulose fibers is improved. The volume average particle diameter of the binding material is, for example, 1.0 to 100.0 μm and preferably 5.0 to 50.0 μm.

After kneading is performed using a kneader, a banbury mixer, a single-screw extruder, a multi-screw extruder, a two-roll mill, a three-roll mill, a continuous kneader, or a continuous two-roll mill, the binding material may be obtained, for example, by palletizing using an appropriate method, followed by pulverization. The binding material may contain particles having various sizes in some cases and may be classified using a known classifying device. In addition, an external shape of the particle of the binding material is not particularly limited, and for example, a sphere, a disc, a fiber, and/or an irregular shape may be used.

In this specification, the "binding between the cellulose fibers and the binding material" indicates a state in which the cellulose fibers are not likely to be separated from the binding material or a state in which the binding material is disposed between the cellulose fibers, and the cellulose fibers are not likely to be separated from each other with the binding material interposed therebetween. In addition, the "binding" is a concept including "adhesion" and indicates a state in which at least two types of objects are in contact with each other and are not likely to be separated from each other. In addition, when the cellulose fibers are bound to each other with the binding material interposed therebetween, the cellulose fibers may be disposed in parallel to each other or may be intersected with each other, or a plurality of cellulose fibers is bound to one cellulose fiber.

In a molded body formed using the web structural body of this embodiment, a method for binding between the cellulose fibers is not particularly limited as long as the cellulose fibers can be bound to each other by melting or softening the binding material. As a device which realizes the binding described above, for example, there may be mentioned a heat press, a heat roller, or a three-dimensional molding machine.

The content of the binding material with respect to the web structural body is 5.0 to 50.0 percent by mass, preferably 7.0 to 45.0 percent by mass, and more preferably 10.0 to 40.0 percent by mass. When the content of the binding material is in the range described above, in the case in which a molded product is formed using the web structural body, sufficient strength/rigidity can be easily obtained, and in addition, even when a three-dimensional shape which requires so-called deep drawing or the like is formed, wrinkles and breakages can be suppressed from being generated in the molded product.

1.2.2. Molten Rate of Binding Material in Thickness Direction of Web Structural Body FIG. 1 is a schematic cross-sectional view showing a web structural body WS which is one example of the web structural body of this embodiment.

The web structural body WS has a sheet-shaped appearance and has a surface WSa at one surface side and a rear surface WSb at the other surface side opposite thereto in a thickness direction. The surface WSa and the rear surface WSb may be arbitrarily selected. Hence, the surface in the following description is regarded to correspond to one surface side or the other surface side (rear surface) of the web structural body.

In the web structural body WS of this embodiment, a molten rate of the binding material BM at the surface of the web structural body WS is higher than a molten rate of the binding material BM at a center in a thickness direction of the web structural body WS.

In this case, the surface of the web structural body WS indicates a region (hereinafter, referred to as "surface region" in some cases) from the surface WSa or the surface WSb to ⅓ of the thickness of the web structural body WS in a depth direction. In addition, the center in the thickness direction of the web structural body WS indicates, for example, a region (hereinafter, referred to as "central region" in some cases) having a thickness of approximately ⅓ of the web structural body WS based on the assumption that a central surface WSc of the web structural body WS in the thickness direction is the center of this region.

The molten rate of the binding material BM indicates a rate of a binding material BM, the shape of which before melting is not maintained, of the binding material BM present in a specific region. For example, when the shape of the binding material BM before melting is a sphere, the molten rate indicates a rate of a binding material BM having no spherical shape with respect to the entire binding material BM present in the specific region.

As the shape of the binding material BM (that is, the molten binding material BM), the shape of which before melting is not maintained, for example, irregular shapes attached and/or agglutinated to cellulose fibers CF may be mentioned. In the example shown in FIG. 1, the binding material BM is schematically shown by black particles each having a round shape (particle shape) in the central region of the web structural body WS and is schematically shown by oval shapes in which the ratio of the major axis to the minor axis is gradually increased from the central region to the surface region. In addition, the example shown in FIG. 1 shows that the binding material BM before melting has a spherical shape (round shape in the drawing), and after the melting of the binding material, the shape thereof is no longer maintained and is changed to a disc shape (oval shape in the drawing).

In the surface region of the web structural body WS, since the surface area of the binding material BM is increased due to the melting and deformation thereof, the contact probability with the cellulose fibers CF is increased, so that binding between the cellulose fibers CF is generated.

Figure 2:
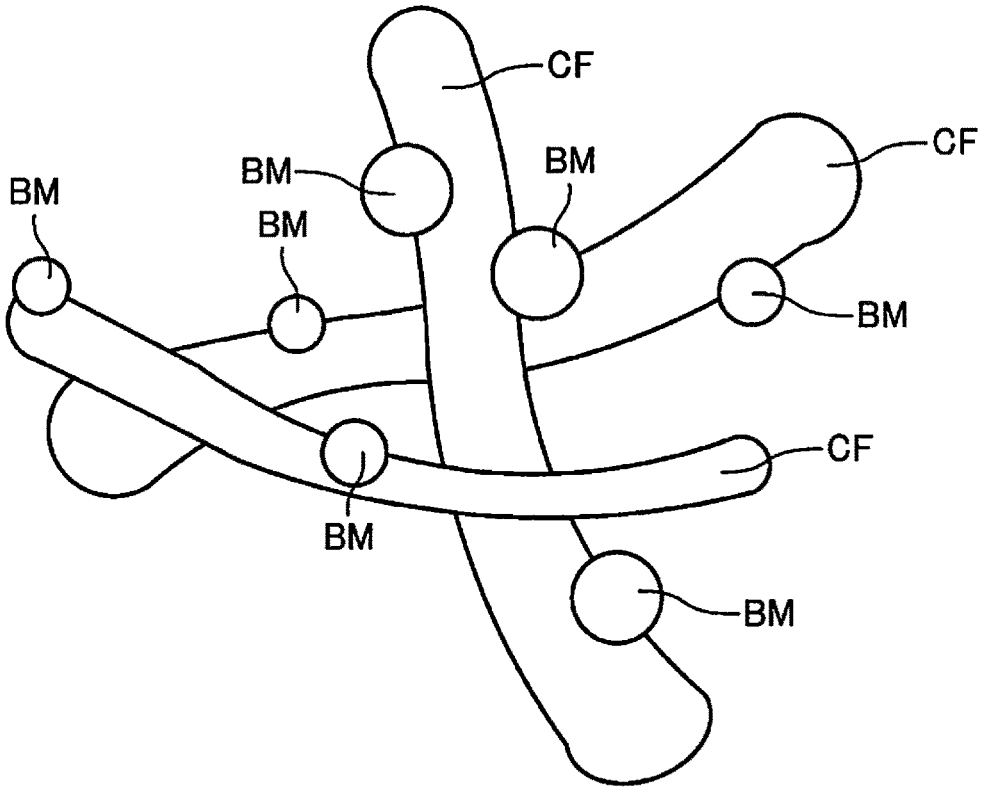
FIG. 2 is a schematic view showing a state of cellulose fibers and a binding material present at a central region in a thickness direction of the web structural body according to the embodiment.
Figure 3:
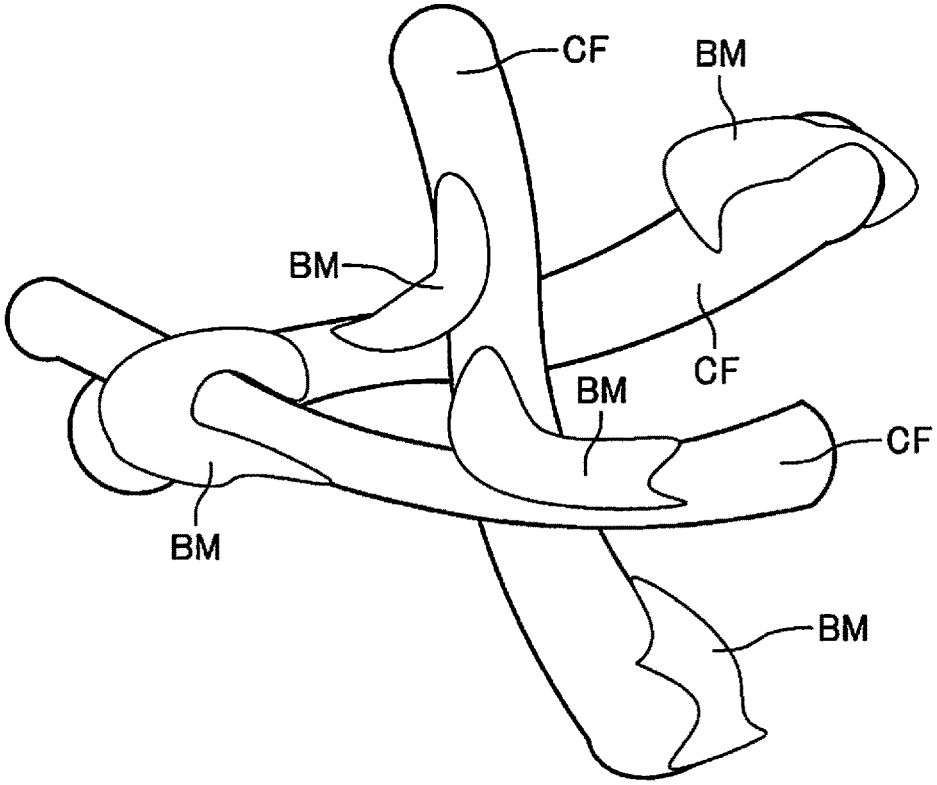
FIG. 3 is a schematic view showing a state of cellulose fibers and a binding material present at a surface region in the thickness direction of the web structural body according to the embodiment.

FIG. 2 is a schematic view showing one example of the state of the cellulose fibers CF and the binding material BM present in the central region of the web structural body WS. FIG. 3 is a schematic view showing one example of the state of the cellulose fibers CF and the binding material BM present in the surface region of the web structural body WS.

As shown in FIG. 2, in the central region of the web structural body WS, the binding material BM has a spherical shape before melting (the particle shape is maintained) and is present so as to be attached to the cellulose fibers CF. In the state described above, although the cellulose fibers CF are not bound to each other, the binding material BM is attached to the cellulose fibers CF and is suppressed from falling down from the cellulose fibers CF. Hence, a binding level between the cellulose fibers CF is low, and as a result, shape followability (deformability, mobility, and flowability of fibers), that is, ease of movement, of the cellulose fibers CF is secured as the fibers.

On the other hand, as shown in FIG. 3, in the surface region of the web structural body WS, the binding material BM loses its spherical shape before melting and is present so as to be tightly agglutinated to the cellulose fibers CF. In the state as described above, the cellulose fibers CF are bound to each other, and the positional relationship between the cellulose fibers CF is fixed. Hence, the binding level between the cellulose fibers CF is high. Since the shape of the web structural body WS in the surface region of is fixed, the exterior shape of the web structural body WS is moderately fixed and maintained, and for example, the web structural body WS is likely to be handled.

The molten rate of the binding material BM is obtained by a microscopic observation and an image processing. Since the binding material BM is melted and deformed as described above, the surface area thereof is increased. Hence, when the microscopic observation is performed, the area of the binding material BM is increased as compared to that before melting. Hence, by measurement of the area of the binding material BM on the microscopic image, whether the binding material BM is melted or not can be determined.

In addition, without observing every particle of the binding material BM, for example, when the surface region and the central region of the web structural body WS are observed using a microscope, and the total area of the binding material BM in the field thus observed is obtained, the molten rate of the binding material BM in each region may also be evaluated.

Furthermore, when the number of the particles of the binding material BM observed by a microscope is increased, the molten rate of the binding material BM present in the observation range may also be treated by a statistical processing technique. For example, the area of the binding material BM before melting obtained by a microscopic image is used as a reference, and the area of the binding material BM at each observation position is treated by a statistical image processing, so that the molten rate of the binding material BM at the position can be estimated.

In addition, since including a portion in which the cellulose fibers CF are not bound to each other, the web structural body WS can be easily deformed, and hence, when a cross-section thereof is exposed and observed, the molten rates of the central region and the surface region of the web structural body WS can b easily estimated.

Figure 4:
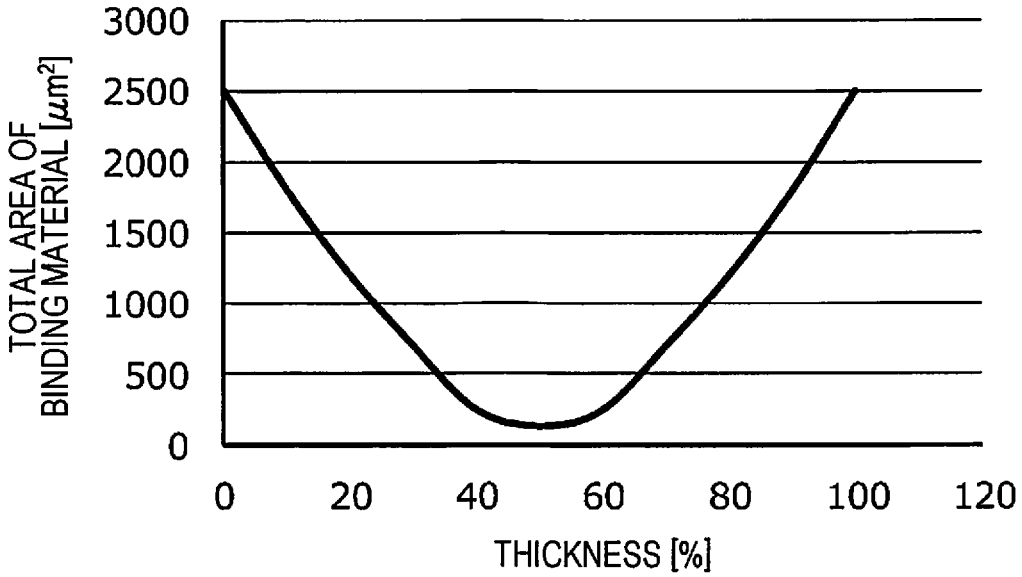
FIG. 4 is a graph showing one example of a distribution of a molten rate of the binding material in the thickness direction of the web structural body according to the embodiment.

FIG. 4 is a graph showing one example of a distribution of the molten rate of the binding material in the thickness direction of the web structural body WS of this embodiment. The horizontal axis of the graph shown in FIG. 4 indicates a position represented by a rate (%) of a thickness in the thickness direction of the web structural body WS when the total thickness thereof is assumed to be 100%, and the vertical axis indicates the total area ($\mu m^3$) of the binding material BM in an image in which a predetermined number of the particles of the binding material BM in the web structural body WS is observed by a microscope. The horizontal axis of the graph shown in FIG. 4 indicates the depth in the thickness direction of the web structural body WS normalized by the thickness thereof, and the vertical axis corresponds to the molten rate of the binding material BM.

As shown in FIG. 4, according to the distribution of the molten rate of the binding material BM in the thickness direction of the web structural body WS of this embodiment, the molten rate is low at the center in the thickness direction and is high at the two ends (surfaces of the web structural body) in the thickness direction.

The molten rate of the binding material BM in the vicinity of the surface of the web structural body WS is, when the molten rate of the binding material BM at the center in the thickness direction of the web structural body WS is regarded as 0.0%, 50.0% to 100.0%, preferably 60.0% to 100.0%, and further preferably 70.0% to 100.0%. When the distribution of the molten rate of the binding material BM in the web structural body WS is in the range as described above, the exterior shape of the web structural body WS is moderately fixed, and hence, the web structural body WS has a toughness and is more likely to be handled. In addition, when the web structural body WS is molded (die molding) into a molded product, sufficient strength/rigidity can be easily obtained, and in addition, even when a three-dimensional shape which requires so-called deep drawing or the like is formed, since the ease of movement (shape followability of the cellulose fibers CF, deformability, mobility, and flowability of the fibers) as the fiber is secured in the central region, the generation of whrinkles and breakages in the molded product can be further suppressed.

In addition, in the example shown in FIG. 4, although the distribution of the molten rate of the binding material BM has a symmetrical shape with respect to the center in the thickness direction of the web structural body WS, as long as the molten rate of the binding material BM is high at the surface and the rear surface, the distribution described above may also have an unsymmetrical shape.

Although the distribution of the molten rate of the binding material BM has thus been described, the amount of the binding material BM present in the web structural body WS may be uniform or may have a distribution in the thickness direction of the web structural body WS.

1.3. Property of Web Structural Body

The web structural body WS has a sheet-shaped appearance. The thickness of the web structural body WS is, for example, 0.5 to 30.0 mm, preferably 1.0 to 20.0 mm, and more preferably 1.5 to 15.0 mm. When a molded product is formed using the web structural body WS having the thickness as described above, sufficient strength/rigidity can be easily obtained, and in addition, even when a three-dimensional shape which requires so-called deep drawing or the like is formed, wrinkles and breakages can be further suppressed from being generated in the molded product.

In addition, the density of the web structural body WS is 0.01 to 0.50 $g/cm^3$, preferably 0.02 to 0.20 $g/cm^3$, and more preferably 0.05 to 0.15 $g/cm^3$. When a molded product is formed using the web structural body WS having the density in the range described above, sufficient strength/rigidity can be easily obtained, and in addition, even when a three-dimensional shape which requires so-called deep drawing or the like is formed, wrinkles and breakages can be further suppressed from being generated in the molded product; hence, for example, containers, such as a food tray, can be easily formed by molding.

2. MANUFACTURING APPARATUS OF WEB STRUCTURAL BODY

A manufacturing apparatus of the web structural body of this embodiment is an apparatus capable of manufacturing the above web structural body. That is, the web structural body manufacturing apparatus includes a mixing portion mixing cellulose fibers and a binding material binding the cellulose fibers to form a mixture; a depositing portion depositing the mixture to form a deposit; and a heating portion heating the deposit to form a web structural body, and in this manufacturing apparatus, the heating portion heats the deposit at a temperature of 70.0° C. to 220.0° C. so that a molten rate of the binding material at a surface of the web structural body is higher than a molten rate of the binding material at a center in a thickness direction of the web structural body.

Figure 5:
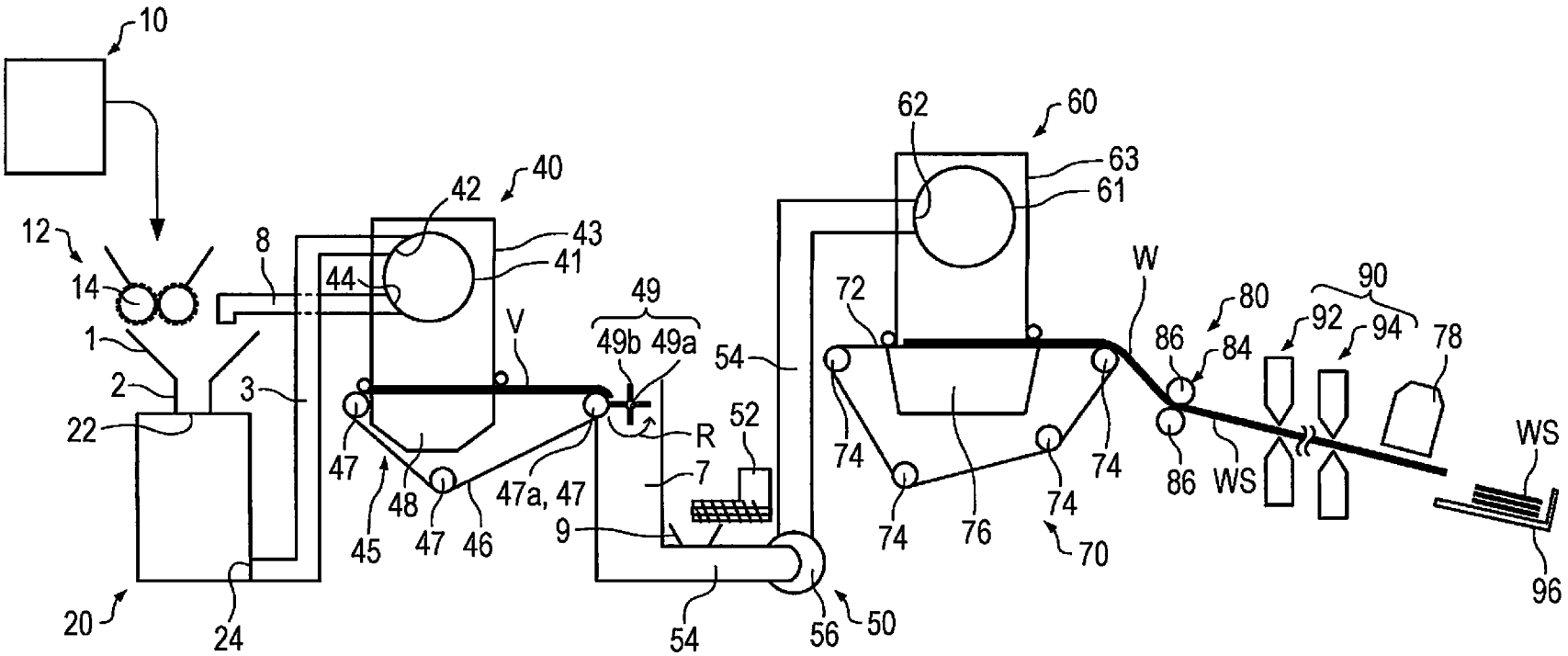
FIG. 5 is a schematic view showing one example of a manufacturing apparatus of the web structural body according to the embodiment.

FIG. 5 is a schematic view showing a web structural body manufacturing apparatus 100 according to this embodiment. As shown in FIG. 5, the web structural body manufacturing apparatus 100 includes a supply portion 10, a coarsely pulverizing portion 12, a defibrating portion 20, a sorting portion 40, a first web forming portion 45, a rotation body 49, a mixing portion 50, a depositing portion 60, a second web forming portion 70, a web structural body forming portion 80, a cutting portion 90, and a humidifying portion 78.

The supply portion 10 supplies a raw material to the coarsely pulverizing portion 12. The supply portion 10 is, for example, an automatic feeder which continuously feeds the raw material to the coarsely pulverizing portion 12. As the raw material supplied to the coarsely pulverizing portion 12, any material containing cellulose fibers may be used.

The coarsely pulverizing portion 12 cuts the raw material supplied by the supply portion 10 into small pieces in a gas atmosphere, such as in the air (air). The small pieces each have, for example, a several centimeters square shape. In the example shown in the drawing, the coarsely pulverizing portion 12 includes at least one coarsely pulverizing blade 14, and by this coarsely pulverizing blade 14, the raw material thus supplied can be cut into small pieces. As the coarsely pulverizing portion 12, for example, a shredder may be used. After being received by a hopper 1, the raw material cut by the coarsely pulverizing portion 12 is fed (transported) to the defibrating portion 20 through a tube 2.

The defibrating portion 20 defibrates the raw material cut in the coarsely pulverizing portion 12. In this case, the "defibrate" indicates that the raw material (material to be defibrated) composed of cellulose fibers bound to each other is disentangled into separately independent cellulose fibers. The defibrating portion 20 may also have a function to separate substances, such as resin particles, an ink, a toner, a filler, and a blurring inhibitor, each of which is attached to the raw material, from the cellulose fibers.

A material passing through the defibrating portion 20 is called a "defibrated material". In the "defibrated material", besides the defibrated cellulose fibers thus disentangled, resin particles (resin particles functioning to bind cellulose fibers together), coloring materials, such as an ink, a toner, and a filler; and additives, such as a blurring inhibitor and a paper reinforcing agent, which are separated from the cellulose fibers when the cellulose fibers are disentangled, may also be contained in some cases.

The defibrating portion 20 performs dry defibration. A treatment, such as defibration, which is performed not in a liquid, such as in water, (wet type, dissolved to form a slurry) but in a gas, such as in the air, is called a dry type. As the defibrating portion 20, in this embodiment, an impellor mill is used. The defibrating portion 20 has a function to generate an air stream which sucks the raw material and discharges the defibrated material. Accordingly, the defibrating portion 20 sucks the raw material from an inlet port 22 together with the air stream generated thereby, then performs a defibrating treatment, and subsequently transports the defibrated material to a discharge port 24. The defibrated material passing through the defibrating portion 20 is transferred to the sorting portion 40 through a tube 3. In addition, as an air stream transporting the defibrated material from the defibrating portion 20 to the sorting portion 40, the air stream generated by the defibrating portion 20 may also be used, or an air generating device, such as a blower, may be provided, and an air stream generated thereby may be used.

The defibrated material defibrated in the defibrating portion 20 flows into the sorting portion 40 through an inlet port 42 and is sorted in accordance with the length of the cellulose fibers. The sorting portion 40 includes a drum portion 41 and a housing portion 43 receiving the drum portion 41. As the drum portion 41, for example, a sieve is used. The drum portion 41 includes a net (a filter or a screen), and cellulose fibers and particles (which pass through the net, first sorted material) smaller than each of the openings of the net may be separated from cellulose fibers, non-defibrated pieces, and damas (which are not allowed to pass through the net, second sorted material) larger than each of the openings of the net. For example, the first sorted material is transported to the mixing portion 50 through a tube 7. The second sorted material is returned to the defibrating portion 20 from a discharge port 44 through a tube 8. In particular, the drum 41 is a cylindrical sieve which is rotatably driven by a motor. As the net of the drum portion 41, for example, there may be used a metal net, an expanded metal obtained by expanding a metal plate having cut lines, or a punched metal obtained by forming holes in a metal plate using a press machine or the like.

The first web forming portion 45 transports the first sorted material passing through the sorting portion 40 to the mixing portion 50. The first web forming portion 45 includes a mesh belt 46, tension rollers 47, and a suction portion (suction mechanism) 48.

The suction portion 48 is able to suck the first sorted material, which passes through the openings (openings of the net) of the sorting portion 40 and which is dispersed in air, on the mesh belt 46. The first sorted material is deposited on the moving mesh belt 46 to form a web V. The basic structures of the mesh belt 46, the tension rollers 47, and the suction port 48 are similar to those of a mesh belt 72, tension rollers 74, and a suction mechanism 76 of the second web forming portion 70, respectively.

Since passing through the sorting portion 40 and the first web forming portion 45, the web V is formed in a softly expanded air-rich state. The web V deposited on the mesh belt 46 is charged to the tube 7 and then transported to the mixing portion 50.

The rotation body 49 is able to cut the web V before the web V is transported to the mixing portion 50. In the example shown in the drawing, the rotation body 49 includes a base portion 49*a* and projecting portions 49*b* projecting from the base portion 49*a*. The projecting portion 49*b* has, for example, a plate shape. In the example shown in the drawing, the four projecting portions 49*b* are provided at regular angular intervals. As the base portion 49*a* is rotated in a direction R, the projecting portions 49*b* are able to rotate around the base portion 49*a*. Since the web V is cut by the rotation body 49, for example, the variation of the amount of the defibrated material per unit time supplied to the depositing portion 60 can be reduced.

The rotation body 49 is provided in the vicinity of the first web forming portion 45. In the example shown in the drawing, the rotation body 49 is provided in the vicinity (adjacent to a tension roller 47*a*) of the tension roller 47*a* located at a downstream side of the path for the web V. The rotation body 49 is provided at a position at which the projecting portion 49*b* is able to be in contact with the web V and not to be in contact with the mesh belt 46 on which the web V is deposited. The minimum distance between the projecting portion 49*b* and the mesh belt 46 is, for example, 0.05 to 0.5 mm.

The mixing portion 50 mixes the first sorted material (the first sorted material transported by the first web forming portion 45) passing through the sorting portion 40 and an additive including the binding material. The mixing portion 50 includes an additive supply portion 52 supplying the additive, a tube 54 transporting the first sorted material and the additive, and a blower 56. In the example shown in the drawing, the additive is supplied to the tube 54 from the additive supply portion 52 through a hopper 9. The tube 54 is extended from the tube 7.

In the mixing portion 50, an air stream is generated by the blower 56, and the first sorted material and the additive can be transported in the tube 54 while being mixed together. In addition, a mechanism of mixing the first sorted material and the additive is not particularly limited, and the mixing may be performed by stirring using at least one high speed rotation blade or using a rotational container, such as a V-shaped mixer.

As the additive supply portion 52, for example, a screw feeder as shown in FIG. 5 or a disc feeder now shown may be used. The additive supplied from the additive supply portion 52 contains the binding material BM described above. When the binding material BM is supplied, the cellulose fibers are not yet bound together. The binding material BM is partially melted when passing through the web structural body forming portion 80, so that cellulose fibers in a surface region of the web structural body WS are bound together.

In addition, in the additive supplied from the additive supply portion 52, besides the binding material BM, in accordance with the type of web structural body WS to be manufactured, a coloring agent coloring the cellulose fibers, an aggregation suppressor suppressing aggregation of the cellulose fibers and aggregation of the binding material BM, and a flame retardant which renders the cellulose fibers or the like difficult to burn may also be contained. A mixture (mixture of the first sorted material and the additive) passing through the mixing portion 50 is transported to the depositing portion 60 through the tube 54.

In the depositing portion 60, the mixture passing through the mixing portion 50 is introduced from an inlet port 62, and an entangled defibrated material (cellulose fibers) is disentangled and is allowed to fall down while being dispersed in air. Accordingly, in the depositing portion 60, the mixture can be uniformly deposited on the second web forming portion 70.

The depositing portion 60 includes a drum portion 61 and a housing portion 63 receiving the drum portion 61. As the drum portion 61, a rotatable cylindrical sieve is used. The drum portion 61 includes a net and allows cellulose fibers and particles (which pass through the net), the size of which is smaller than the openings of the net, contained in the mixture passing through the mixing portion 50 to fall down. The structure of the drum portion 61 is, for example, the same as that of the drum portion 41.

In addition, the "sieve" of the drum portion 61 may have no function to sort a specific object. That is, the "sieve" used as the drum portion 61 indicates a portion including a net, and the drum portion 61 may allow all the mixture introduced in the drum portion 61 to fall down.

The second web forming portion 70 deposits a material passing through the depositing portion 60 to form a web W which is a deposit to be formed into the web structural body WS. The second web forming portion 70 includes, for example, the mesh belt 72, the tension rollers 74, and the suction mechanism 76.

While the mesh belt 72 moves, a material passing through the openings (openings of the net) of the depositing portion 60 is deposited on the mesh belt 72. The mesh belt 72 is suspended by the tension rollers 74 and is configured to allow air to pass but not to allow the material thus deposited to easily pass. The mesh belt 72 moves as the tension rollers 74 rotate. While the mesh belt 72 continuously moves, since the material passing through the depositing portion 60 continuously falls and deposits, the web W is formed on the mesh belt 72. The mesh belt 72 is composed of, for example, a metal, a resin, a cloth, or a non-woven cloth.

The suction mechanism 76 is provided under the mesh belt 72 (opposite to a depositing portion 60 side). The suction mechanism 76 can generate a downward air stream (air stream from the depositing portion 60 to the mesh belt 72). By the suction mechanism 76, a mixture dispersed in air by the depositing portion 60 can be sucked on the mesh belt 72. Accordingly, a discharge rate from the depositing portion 60 can be increased. Furthermore, by the suction mechanism 76, a downflow can be formed in a falling path of the mixture, and the defibrated material and the additive are suppressed from being entangled together during the falling.

As described above, by the depositing portion 60 and the second web forming portion 70 (web forming step), the web W is formed in a softly expanded air-rich state. The web W deposited on the mesh belt 72 is transported to the web structural body forming portion 80. The thickness of the web W (deposit) transported to the web structural body forming portion 80 is preferably 1.0 to 150.0 mm, more preferably 2.0 to 120.0 mm, and further preferably 5.0 to 100.0 mm. In addition, the density of the web W (deposit) is 0.02 to 0.05 $g/cm^3$ and preferably 0.02 to 0.03 $g/cm^3$.

The web structural body forming portion 80 heats the web W deposited on the mesh belt 72 to form the web structural body WS. In the web structural body forming portion 80, the deposit (web W) of the mixture of the defibrated material and the additive mixed therewith is heated, so that the binding material BM in the surface region can be melted. By the molten binding material BM, the cellulose fibers may be bound to each other.

The web structural body forming portion 80 includes a heating portion 84 heating the web W. As the heating portion 84, for example, a heat press or a heating roller (heater roller) may be used, and hereinafter, an example of using at least one heating roller (heater roller) will be described. The number of the heating rollers of the heating portion 84 is not particularly limited. In the example shown in the drawing, the heating portion 84 includes a pair of heating rollers 86. Since the heating portion 84 is formed using the heating rollers 86, while the web W is continuously transported, the web structural body WS can be formed. The heating rollers 86 are disposed such that, for example, the rotation shafts thereof are in parallel to each other. The roller radius of the heating roller 86 is, for example, 2.0 to 5.0 cm, preferably 2.5 to 4.0 cm, and more preferably 2.5 to 3.5 cm.

While being brought into contact with the heating rollers 86 and sandwiched therebetween, the web W is transported and heated by the heating rollers 86. A rotation rate of the heating roller 86 is, for example, 20.0 to 500.0 rpm, preferably 30.0 to 350.0 rpm, and more preferably 50.0 to 300.0 rpm. When the rotation rate of the heating roller 86 is as described above, the surface region of the web W can be sufficiently and uniformly heated.

The heating rollers 86 sandwich and transport the web W to form a web structural body WS having a predetermined thickness. In this step, the pressure applied to the web W by the heating rollers 86 is preferably low. In addition, when the web W is pressurized by the heating rollers 86, the pressure is preferably applied so that the density of the web structural body WS formed from the web W is 0.3 $g/cm^3$ or less and preferably 0.25 $g/cm^3$ or less.

A surface temperature of the heating roller 86 when the web W is heated is appropriately set in consideration of Tg and the melting point of a resin contained in the binding material BM and is, for example, 60.0° C. to 250.0° C., preferably 70.0° C. to 220.0° C., and more preferably 80.0° C. to 200.0° C. When the surface temperature of the heating roller 86 is set in the range as described above, the surface of the web W (deposit) can be heated in the temperature range described above.

When the heating rollers 86 are brought into contact with the web W, the surface thereof is heated, and the binding material in the surface region is melted. Since the density of the web W is as described above, and the heat conductivity of the web W in a thickness direction is suppressed, the binding material BM present in the web W is not melted. Accordingly, the web structural body WS can be manufactured such that the molten rate of the binding material BM at the surface is higher than the molten rate of the binding material BM at the center in the thickness direction.

A gap between the pair of heating rollers 86 of the heating portion 84 is preferably adjusted so that the thickness of the web structural body WS is 1.0 to 20.0 mm, preferably 2.0 to 18.0 mm, and more preferably 3.0 to 15.0 mm, and the density of the web structural body WS is 0.02 to 0.20 g/cm$^3$ and preferably 0.03 to 0.18 g/cm$^3$.

By the web structural body manufacturing apparatus 100 of this embodiment, the web structural body WS of this embodiment can be manufactured as described above.

The web structural body manufacturing apparatus 100 of this embodiment may further include the cutting portion 90, if needed. In the example shown in the drawing, the cutting portion 90 is provided at a downstream side of the heating portion 84. The cutting portion 90 cuts the web structural body WS formed by the web structural body forming portion 80. In the example shown in the drawing, the cutting portion 90 includes a first cutting portion 92 which cuts the web structural body WS in a direction intersecting the transport direction of the web structural body WS and a second cutting portion 94 which cuts the web structural body WS in a direction parallel to the transport direction. The second cutting portion 94 cuts, for example, the web structural body WS which passes through the first cutting portion 92.

In addition, the web structural body manufacturing apparatus 100 of this embodiment may further include the humidifying portion 78. In the example shown in the drawing, the humidifying portion 78 is provided at a downstream side of the cutting portion 90 and an upstream side of a discharge portion 96. The humidifying portion 78 can supply water or vapor to the web structural body WS. As a concrete mode of the humidifying portion 78, for example, there may be mentioned a mode in which mist of water or an aqueous solution is sprayed, a mode in which water or an aqueous solution is sprayed, or a mode in which water or an aqueous solution is ejected from an ink jet head for attachment.

Since the web structural body manufacturing apparatus 100 includes the humidifying portion 78, the web structural body WS thus formed may have moisture. Accordingly, the cellulose fibers are wetted and softened. Hence, when a three-dimensional container is formed using the web structural body WS, wrinkles and breakages are more unlikely to be generated. In addition, since the web structural body WS has moisture, hydrogen bonds are likely to be formed between the cellulose fibers; hence, the density of a molded container or the like is increased, and for example, the strength thereof can be improved.

In the example shown in FIG. 5, although the humidifying portion 78 is provided at the downstream side of the cutting portion 90, as long as the humidifying portion 78 is provided at the downstream side of the heating portion 84, the same effect as described above can be obtained. That is, the humidifying portion 78 may be provided at the downstream side of the heating portion 84 and at an upstream side of the cutting portion 90.

Accordingly, the web structural body WS is formed. The web structural body WS thus manufactured is cut, for example, by the cutting portion 90 and is then, if needed, discharged to the discharge portion 96. Alternatively, the web structural body WS may be wound into a roll shape without being cut.

The present disclosure is not limited to the embodiments described above and may be variously changed or modified. For example, the present disclosure includes substantially the same structure as the structure described in the embodiment. That is, the substantially the same structure includes, for example, the structure in which the function, the method, and the result are the same as those described above, or the structure in which the object and the effect are the same as those described above. In addition, the present disclosure includes the structure in which a nonessential portion of the structure described in the embodiment is replaced with something else. In addition, the present disclosure includes the structure which performs the same operational effect as that of the structure described in the embodiment or the structure which is able to achieve the same object as that of the structure described in the embodiment. In addition, the present disclosure includes the structure in which a known technique is added to the structure described in the embodiment.

What is claimed is:

1. A manufacturing apparatus of a web structural body, the apparatus comprising, a mixing portion mixing cellulose fibers and a binding material binding the cellulose fibers to form a mixture;

a depositing portion depositing the mixture to form a deposit;

a heating portion heating the deposit to form the web structural body; and a humidifying portion humidifying the web structure body, the humidifying portion being disposed on a downstream side of the heating portion, wherein the heating portion heats the deposit at a temperature of 70.0° C. to 220.0° C. so that a molten rate of the binding material at a surface of the web structural body is higher than a molten rate of the binding material at a center in a thickness direction of the web structural body.

2. The manufacturing apparatus of a web structural body according to claim 1, wherein the heating portion includes a pair of heating rollers, and the heating rollers each have a rotation rate of 30.0 to 350.0 rpm.

3. The manufacturing apparatus of a web structural body according to claim 1, wherein the mixing portion mixes so that the binding material has a content of 5.0 to 50.0 percent by mass with respect to the deposit, the depositing portion deposits so that the deposit has a thickness of 1.0 to 150.0 mm, and the heating portion heats so that the web structural body has a thickness of 1.0 to 20.0 mm and a density of 0.02 to 0.20 g/cm$^3$.

* * * * *